United States Patent [19]

Michaels et al.

[11] Patent Number: 4,707,047

[45] Date of Patent: Nov. 17, 1987

[54] ENVIRONMENTALLY SEALED ELECTRICAL CONNECTOR

[75] Inventors: Leonard H. Michaels, Warrenville; Robert A. Miller, Woodridge, both of Ill.

[73] Assignee: Molex Incorporated, Lisle, Ill.

[21] Appl. No.: 830,796

[22] Filed: Feb. 19, 1986

[51] Int. Cl.[4] ..... H01R 13/52

[52] U.S. Cl. ..... 439/271; 439/277

[58] Field of Search ..... 339/94 R, 94 C, 94 M, 339/89 R, 89 C, 89 M, 90 R, 90 C

[56] References Cited

U.S. PATENT DOCUMENTS

| | | | |
|---|---|---|---|
| 2,949,642 | 8/1960 | Lieberman | 339/89 M |
| 2,981,920 | 4/1961 | Jackson | 339/89 C |
| 3,643,206 | 2/1972 | Cowmeadow | 339/94 R |
| 4,173,385 | 11/1979 | Fenn et al. | 339/89 C |

FOREIGN PATENT DOCUMENTS

| | | | |
|---|---|---|---|
| 1127425 | 4/1962 | Fed. Rep. of Germany | 339/94 R |

*Primary Examiner*—John McQuade

*Attorney, Agent, or Firm*—John W. Cornell; Louis A. Hecht

[57] ABSTRACT

A backshell sealing arrangement adapted to make an environmental seal with a variety of frontshell configurations is provided. The backshell includes a generally cylindrical rigid outer shell having a coupling portion with internal threads adapted to engage external threads adjacent the cable end of a plug and receptcle-type connector frontshell. A shoulder is provided in the backshell radially inward of the internal threads and adjacent the coupling portion having a surface which faces the frontshell cable end. A recess is provided radially between the shoulder and an external wall of the backshell. A ring-like resilient gasket of rectangular cross-section elongated in a radial direction is disposed in the backshell such that the outer radial portions of the gasket are received in the recess and the inner axial portions of the gasket are supported on the surface of the shoulder. In mated condition, the arrangement provides an environmental seal with frontshells having smooth or serrated, thin walled or thick walled cable ends, regardless of whether inserts carried in the frontshell are flush or recessed at the cable entry end.

4 Claims, 10 Drawing Figures

ENVIRONMENTALLY SEALED ELECTRICAL CONNECTOR

BACKGROUND OF THE INVENTION

1. Field of the Invention

The present invention pertains to environmentally sealed backshells for electrical connectors of the plug and receptacle type.

2. Description of the Prior Art

The present invention pertains to ruggedized mating electrical connectors, each of which are enclosed in an outer metallic shell. Specifically, each connector receives a dielectric insert in which a plurality of electrical terminals are mounted. Such electrical connectors are typically required in the aircraft ground support and automotive industries, as well as in machinery and outdoor, unprotected environments. In these applications cable backshells are frequently employed including a rigid outer shell threadingly engaged onto the cable entry end of the mateable connector halves or frontshells. Backshells typically provide strain relief means to protect against cable shocks or pull-out which may cause damage to the frontshell connector components.

In many environments, water or moisture present in the air or in contact with the connector present a problem to the electrical connections within a mated electrical connector pair. Accordingly, as a second important feature, mated connector pairs of this type provide an arrangement for sealing the conductor-entry end of each connector part, as well as providing sealing at the mating face of the connector part. An example of such a sealing arrangement is shown in commonly owned U.S. Pat. No. 4,472,012. In that arrangement, each connector insert is made of a resilient elastomeric material effective for not only receiving and mounting an electrical terminal therein, but also for providing a sealing interface with the complementary connectors of the assembled pair.

Other sealing arrangements include an "O"-ring to effect sealing at the mating face between the backshell and the cable end of the frontshell. Seals of this and similar types require a well defined, rotatably engageable, mating face at the connector end to which the seal is mated. However, several different configurations for the coupling interface between the backshell and frontshell are encountered. One of these types presents a relatively smooth end wall on the frontshell cable end to engage the sealing member. Another type is illustrated in U.S. Pat. No. 4,536,048, and includes serrations on the frontshell cable end to provide anti-decoupling.

In the past, different backshells were required to mate with the different types of frontshell cable end configurations. However, to reduce inventory and to provide a multiple purpose backshell, a backshell sealing arrangement for mating with both the serrated type as well as smooth wall type frontshell cable ends is desired.

Due to increasing miniaturization of environmental connectors, one well-known backshell sealing method is no longer a viable alternative to the connector manufacturer. The sealing arrangement referred to is one in which a rigid backshell is threaded onto a radially inner cable end on a front shell member. The threaded portion of the backshell includes a pocket-like recess for receiving an "O"-ring. This O-ring makes contact with the threaded external threads of the cable end of the front shell. However, as mentioned above, with increasing miniaturization of environmental connectors this mating arrangement is not available when the axially extending threaded portion of the backshell must be reduced to a minimum dimension. Typically, only three or four threads can be located on the backshell and the space generally correpsonding to two threads in size can no longer be provided for the O-ring. However, it is desirable to provide mating of the same backshell with a variety of front shell configurations having smooth or serrated mating end walls and/or protruding or recessed insert portions located interior of the external threads of the front shell adjacent the cable entry face thereof.

Accordingly, it is an object of the present invention to provide a versatile backshell seal for sealing the backshell interface with a plurality of frontshell configurations.

SUMMARY OF THE INVENTION

In accordance with this and other objects, the present invention provides an environmental sealing arrangement for a backshell to frontshell connection of the type including:

a connector frontshell including a generally cylindrical rigid outer shell having a cable entry end and external threads adjacent said cable entry end;

a backshell including a generally cylindrical rigid outer shell with a coupling portion dimensioned to telescopically receive said cable entry end of the frontshell, said coupling portion including internal threads adapted to engage the external threads on the frontshell; and sealing means disposed in said coupling portion for engaging the cable entry end to provide an environmental seal between the frontshell and backshell, the improvement in said sealing means comprising:

a ring-like resilient gasket of rectangular cross-section generally elongated in a radial direction;

the backshell outer shell having a shoulder radially inward of said internal threads, adjacent the coupling portion having a mating surface facing the frontshell cable entry end and engageable with radially inner portions of said gasket; and a recess formed in said coupling portion radially positioned between said shoulder and an exterior wall of said backshell outer shell, said recess extending in axial directions on either side of said shoulder mating surface for receiving and supporting radially outer portions of said gasket;

whereby said shoulder and said recess cooperate with radially inner and radially outer portions of said gasket, respectively, to provide environmental sealing with a variety of frontshells having differing cable entry end configurations.

BRIEF DESCRIPTION OF THE DRAWING

In the drawings, wherein like elements are referenced alike.

DETAILED DESCRIPTION OF THE PREFERRED EMBODIMENT

Figure 1:
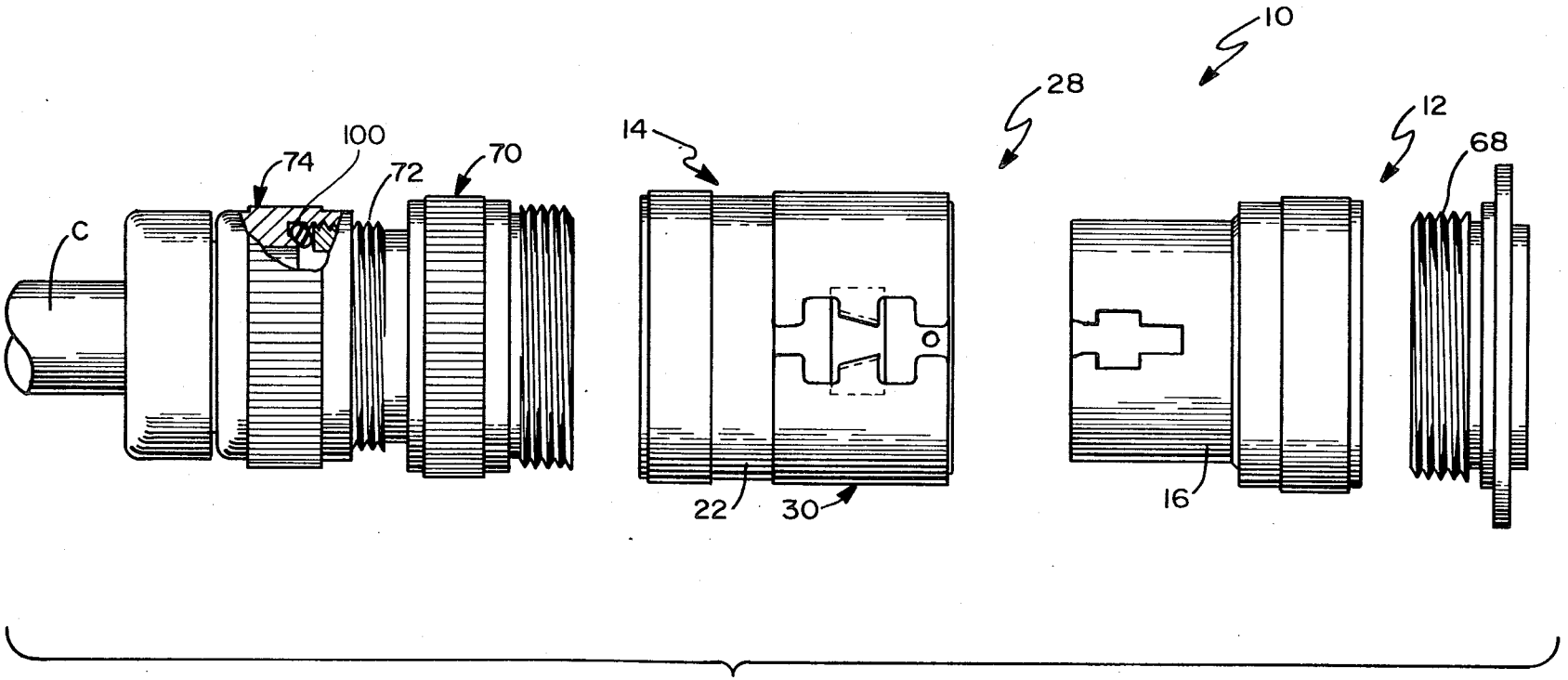
FIG. 1 is an exploded view of a connector assembly according to the present invention.

Referring now to the drawings, and especially to FIG. 1 an environmentally sealed connector assembly is generally indicated at 10. Assembly 10 includes interfitting manually telescoping separable plug and receptacle connectors indicated generally at 12 and 14, respectively. Plug connector 12 has an outer metallic shell 16 a dielectric housing mounted within the shell, and a plurality of female sleeve-type electrical terminals mounted within the housing.

Receptacle connector 14 has an outer metallic shell 22 dimensioned to telescopically receive plug shell 16. A dielectric housing is mounted within the shell, and a plurality of pinlike male electrical terminals adapted to mate with plug termials, are mounted within the housing. While shells 16,22 are preferably of metal, other rigid materials such as high strength plastic may be used.

According to the present invention, plug and receptacle connectors 12, 14 are provided with a coupling lock which provides selective locking and unlocking of the connector members during mating and unmating.

FIG. 1 shows one example of a completed connector assembly comprising connector parts 12, 14. Plug connector 12, for example, is shown mated to a threaded flange mounting 68 which is intended for bolted securement to an equipment item. The receptacle connector 14 is shown connected to a coupling element generally indicated at 70, having a rearward external threaded portion 72. Coupled elements 14 and 70 together form an assembled frontshell and will referred to as frontshell 70 hereinafter. Rearward portion 72 Coupling 70 is in turn threadingly connected to a strain relief cap or backshell generally indicated at 74 which engages a cable C having conductors electrically connected to receptacle terminals.

Figure 2:
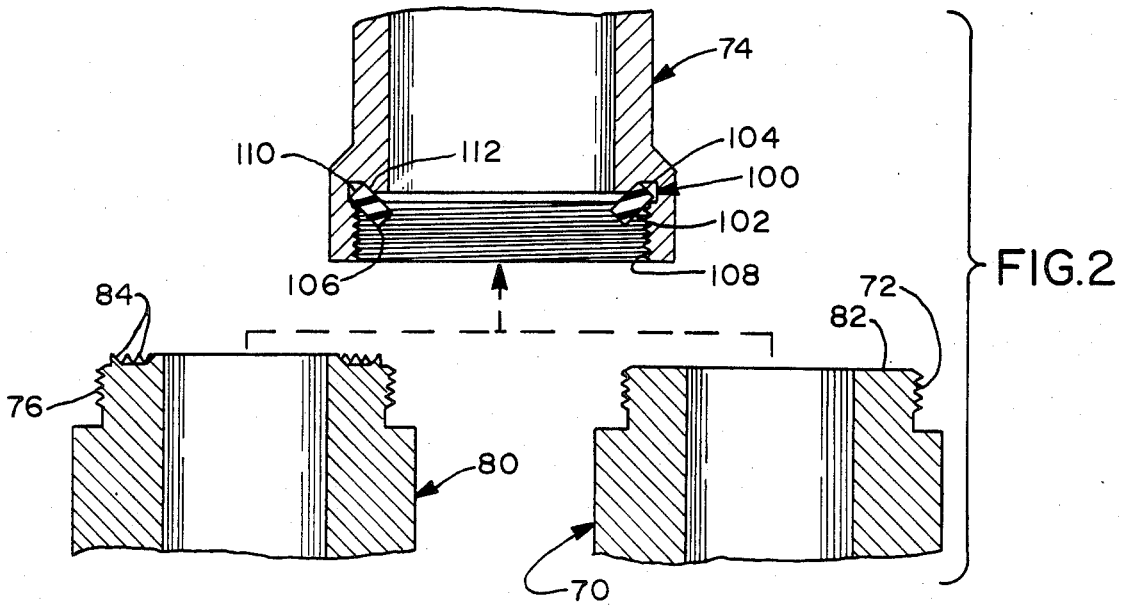
FIG. 2 is an exploded view of a connector system wherein two alternative frontshell members can be mated with the same new and improved sealed backshell of the present invention.

Referring now to FIG. 2, the sealing and interface between members 70, 74 will be described. In the particular embodiment shown in FIG. 1, threaded portion 72 of frontshell 70 has a smooth end wall depicted in the lower right hand portion of FIG. 2. However, an alternative threaded portion 76 is also frequently encountered in particular connector applications. The alternative threaded portion 76 of an alternative frontshell 80, shown at the bottom left hand portion of FIG. 2, has a serrated end wall as is known in the art. Thus, FIG. 2 shows two different alternative frontshell arrangements 70, 80 either of which may be fitted to the same backshell 74. The principle difference between frontshells 70, 80 is in the end wall construction 82, 84 of their threaded portions 72, 76. End wall portion 82 of frontshell 70 presents a smooth annular mating surface to the interior portions of backshell 74. However, the end wall portion 84 of frontshell 80 contains serrations or outward discontinuous projections which provide anti-decoupling, as is known in the art. The problem arises when the same backshell 74 must be sealingly mated with either frontshell 70 or 80.

According to the present invention, the environmental sealing gasket 100 has a funnel shape with opposed end portions 102, 104 of reduced and enlarged diameters, respectively. Also according to the present invention, the rectangular cross-sectional configuration of gasket 100 presents a leading corner 106 which is radially inwardly displaced relative to the outer thread portion of the frontshell which it receives. Thus, the corner 106 of gasket 100 is directed to the radially inner portions of serrated end 84 of frontshell 80, avoiding contact with the serration tips. Further advantges are realized by the gasket 100 of the present invention, since the leading mating surface thereof comprises outside corner 106 of reduced area which experiences a localized high pressure upon threading engagement of the two threaded parts 74, 70 or alternatively 74, 80.

Referring now to the upper portion of FIG. 2, backshell or cap 74 has provided therein, adjacent its thread-receiving bore 108, a pocket-like recess 110 generally rectangular in cross-section. Pocket 110 has an inner generally truncated conical seating surface 112 which maintains the generally inwardly directed taper or angular orientation of gasket 100. This particular orientation of pocket 110 not only maintains the generally funnel-shaped configuration of gasket 100, but also provides an adjacent large diameter gasket end 104 which controls the spreading or "growing" of gasket 100 as the frontshell member is advanced into threaded bore 108. The environmental sealing of gasket 100 is provided at its leading corner 106 with an improved high pressure spring-shaped point of contact, and a larger major side which mates with conical seat 112. This provides an improved deformation of gasket 100 as the connector portions are accordingly mated.

Figure 3:
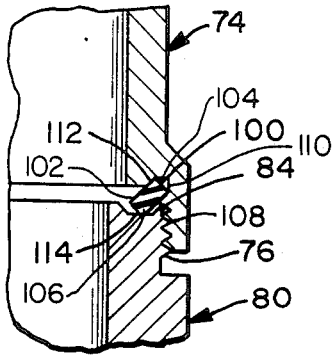
FIG. 3 shows the new and improved backshell of the present invention mated with one of the frontshells of FIG. 2.
Figure 4:
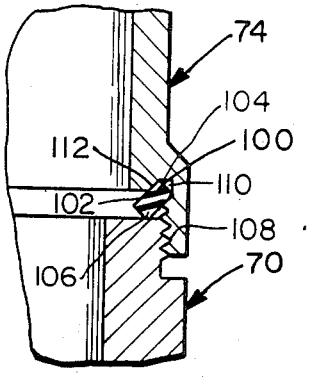
FIG. 4 shows the sealed backshell mated with the other frontshell shown in FIG. 2.

Referring now to FIG. 3, it can be seen that the leading corner 106 of the smaller diameter gasket end is received radially interiorly of serration tips 84 so as to seat on a relatively smooth inner portion 114 of the end wall of frontshell 80. Further, any minor misorientation between serrations 84 and seal 100 results in a smooth sliding interengagement therebetween, owing to the complementary angular orientation of gasket 100. The same gasket 100 provides an adequate seal with the end wall portion of frontshell 70 as shown in FIG. 4.

As a further example of the sealing arrangement of the present invention, reference is made to FIGS. 5–10 showing a variation of the above-described gasket, which is identified by the reference numeral 120. Generally, gasket 120 has the same cross-sectional area and dimensions as gasket 100, except that it is arranged to lie in a radial plane, a "flat" configuration, whereas gasket 100 has a "tapered" or "conical" configuration. According to the present invention, either arrangement of gaskets 100, 120 can be used interchangeably. However, when the "flat" gasket 120 is used, the previously-described pocket-like recess 110 must be extended in an axial direction as indicated in the modified recess 119 of FIG. 5. Enlarged recess 119 is defined by opposed radially extending wall portions 138 and 140 and an axially extending wall 122 extending therebetween adapted to engage the outer radial surface of gasket 120. Further, recess 119 is undercut with respect to the mating surface of a radially inner shoulder 124. Expressed another way, the mating surface of radially inner shoulder 124 is axially positioned at a point intermediate the end walls 138 and 140 of recess 119, best shown in FIGS. 12–16.

The portion of recess 119 adjacent end wall 140 provides a first gasket-receiving region needed during deformation of the gasket (100 or 120), and the portion of recess 119 adjacent end wall 138 forms another region which receives the relaxed flat washer 120.

Figure 5:
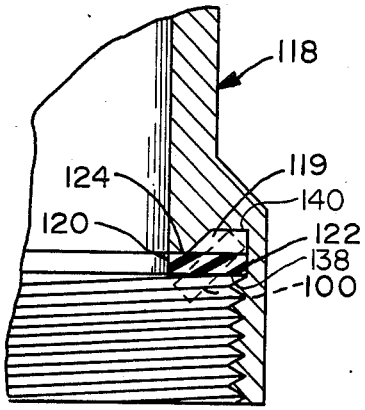
FIGS. 5–10 show another sealed backshell of this invention mated with a variety of frontshell configurations.

The particular advantages of the arrangement of FIG. 5 will become apparent with reference to FIGS.

Figure 6:
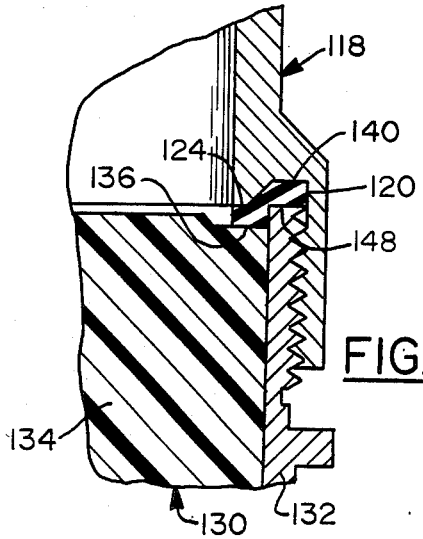
Figure 7:
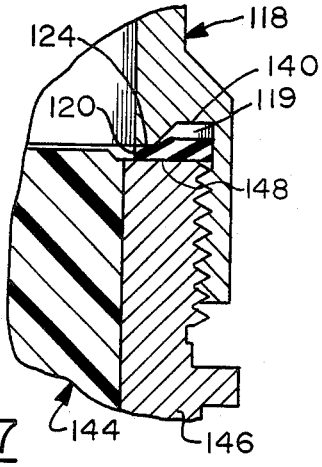
Figure 8:
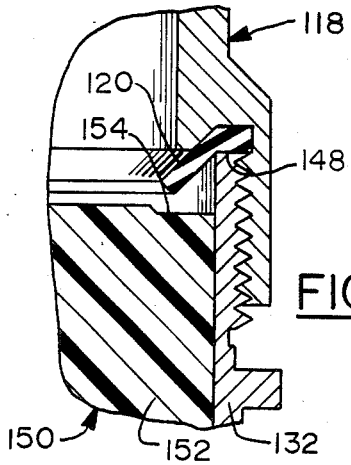
Figure 9:
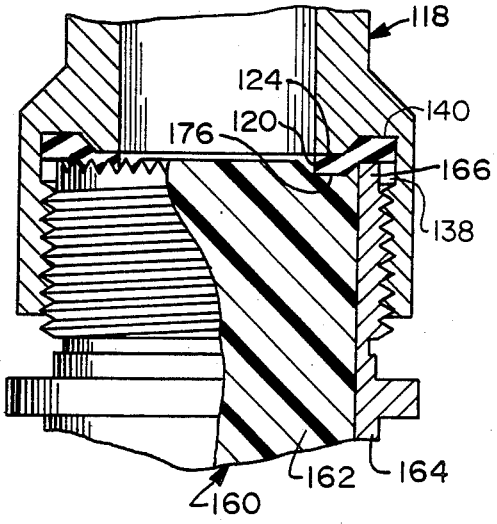
Figure 10:
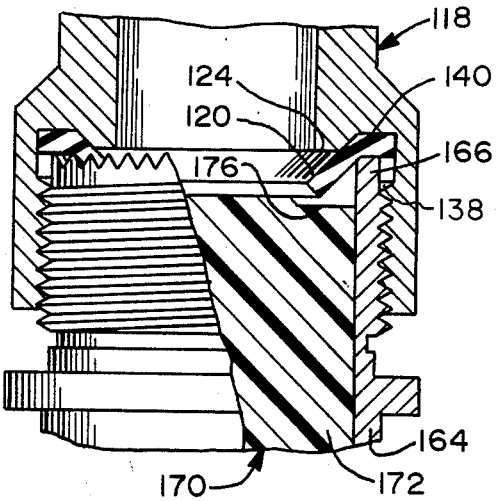

6–10. FIGS. 6–8 correspond to a smooth end wall frontshell, such as frontshell 70 shown in the bottom right hand corner of FIG. 2. FIGS. 9 and 10 correspond to serrated end wall construction such as that shown in the bottom left hand corner of FIG. 2. The same seal, whether it be gasket 100 or gasket 120, provides effective environmental sealing in each of the arrangements of FIGS. 6–10.

Referring now to FIG. 6, the outer shell 118 comprises a portion of a "backshell" connector, a term familiar to those skilled in the environmental connector art. The backshell connector is mated to a "front shell" generally designated at 130, having a rigid outer shell 132 and a dielectric insert 134 which carries a plurality of electrical terminals (not shown) designed to mate with the terminals of another frontshell (also not shown). As shown in FIG. 6, insert 134 includes an annular mating face 136 arranged opposite the inner shoulder 124 of shell 118. When shells 118, 132 are fully mated, the radially inner portion of gasket 120 is compressed between surfaces 124, 136. Further, radially outer portions of the same gasket 120 are compressed between the smooth wall 148 appearing at the free or cable entry end of shell 132, and opposing end wall 140 of recess 119.

Referring now to FIG. 7, the same outer shell 118 and gasket 120 provide mating with a different front shell 144 having a rigid outer shell 146 of increased thickness, which overlies not only recess 119, but also inner shoulder 124 of backshell 118. When shells 118, 146 are fully mated, the smooth-walled free end 148 of outer shell 146 engages gasket 120, so as to compress the gasket against inner shoulder 124 of backshell 118. In this embodiment, the radially outer portion of gasket 120 is free to grow or expand within recess 119, the recess here not playing an active role in providing sealing between the mating rigid shell members.

Referring now to FIG. 8, the same backshell 118 and gasket 120 provide sealing engagement with a front shell connector 150 substantially identical to the connector arrangement 130 of FIG. 6, except that the dielectric insert 152 thereof is axially recessed away from mating portions of backshell 118. In this embodiment, seal 120 is compressed only at its radially outer portion, by the free end 148 of outer shell 132. The radially outer edge 154 of insert 152 does not play an active role in the seal engagement between the seal members 118, 132.

Referring now to FIG. 9, the sealing arrangement of the present invention will be described with reference to a front shell connector 160 comprising an outer shell 164 having toothserrations 166 at its free end, similar to the serrations described above with reference to FIGS. 2 and 3. In this embodiment, gasket 120 is compressed between an annular outer edge 176 on the mating face of insert 162, and the mating surface of inner shoulder 124 of backshell 118. The pointed tips of serrations 166 may be allowed to contact the radially outer portion of gasket 120, but preferably will not penetrate the gasket, thereby permitting multiple operations of the gasket.

With reference to FIG. 10, the sealing arrangement of the present invention can accommodate a slightly different front shell connector 170 having an insert 172 axially recessed away from backshell 118 (as in FIG. 8). In this embodiment, gasket 120 is compressed between the serration 166 and the opposing wall 140 of recess 119. In this embodiment, serrations 166 must penetrate into gasket 120 to provide the required sealing. The radially inner portions of gasket 120 and the outer annular edge 176 of the mating face of insert 172 does not play an active role in the sealing engagement.

According to the present invention, the previously described conical gasket 100 may be employed in each of the arrangements of FIGS. 6–10, and will function identically to the flat gasket 120 owing to the unique arrangement of recess 119 and the inner protruding shoulder 124 of backshell 118. Thus, with a single sealing arrangement (provided with the backshell and gasket of the present invention), sealing engagement can be provided with a variety of front shell configurations having free ends with protruding and recessed inserts, with smooth walled or serrated outer shells, and with all permutations and combinations of these front shell connector characteristics, and does so in such manner that no thread engagement is lost because of the sealing method.

I claim:

1. An environmental sealing arrangement for a backshell to frontshell connection of the type including:

a connector frontshell including a generally cylindrical rigid outer shell having a cable entry end and external threads adjacent said cable entry end;

a backshell including a generally rigid outer shell with a coupling portion including internal threads adapted to threadingly engage the external threads on the frontshell; and sealing means disposed in said coupling portion for engaging the cable entry end to provide an environmental seal between the frontshell and backshell, the improvement in said sealing means comprising:

a ring-like resilient gasket of rectangular cross-section elongated in a radial direction;

the backshell including a shoulder radially inward of said internal threads disposed adjacent the coupling portion having a mating surface facing the frontshell cable end and engageable with radially inner portions of said gasket; and a recess formed in said coupling portion radially positioned between said shoulder and an external wall of said backshell, said recess extending axially on both sides of said shoulder surface for receiving and supporting radially outer portions of the gasket;

whereby the shoulder and the recess cooperate with radially inner and radially outer portions of said gasket, respectively, to provide environmental sealing with a variety of frontshells having differing cable entry end configurations.

2. The sealing arrangement of claim 1, wherein a portion of said recess axially extending to one side of said shoulder mating surface is dimensioned to receive substantially the entire outer portion of said gasket, and the recess portion extending in an opposite axial direction is also dimensioned to receive substantially the entire outer portion of said gasket.

3. The arrangement of claim 1, wherein said gasket is generally conical, having opposed radial end portions of reduced and enlarged diameters, extending toward and away from said frontshell cable end, respectively.

4. The arrangement of claim 1 wherein said gasket extends radially inwardly and radially outwardly from said internal threads of the backshell coupling portion for axial compression by the cable entry end of a frontshell threadingly mated in said coupling portion.

* * * * *